US009028226B2

(12) United States Patent
Hirata et al.

(10) Patent No.: US 9,028,226 B2
(45) Date of Patent: May 12, 2015

(54) FLUID CONTROL DEVICE

(75) Inventors: Atsuhiko Hirata, Nagaokakyo (JP); Yukiharu Kodama, Nagaokakyo (JP); Kenta Omori, Nagaokakyo (JP); Masaaki Fujisaki, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 366 days.

(21) Appl. No.: 13/603,713

(22) Filed: Sep. 5, 2012

(65) Prior Publication Data

US 2013/0058810 A1 Mar. 7, 2013

(30) Foreign Application Priority Data

Sep. 6, 2011 (JP) ..... 2011-194429

(51) Int. Cl.
*F04B 17/03* (2006.01)
*F04B 43/04* (2006.01)
*F04B 45/047* (2006.01)

(52) U.S. Cl.
CPC ..... *F04B 43/043* (2013.01); *F04B 45/047* (2013.01)

(58) Field of Classification Search
CPC ..... F04B 43/046; F04B 45/047
USPC ..... 417/413.2, 413.3; 92/91, 92
See application file for complete search history.

(56) References Cited

U.S. PATENT DOCUMENTS 5,271,724 A * 12/1993 van Lintel ..... 417/413.2
7,299,815 B2 11/2007 Yamanishi
7,631,852 B2 * 12/2009 Richter et al. ..... 251/61.1
2005/0053504 A1 3/2005 Yamanishi
2005/0089415 A1 * 4/2005 Cho et al. ..... 417/413.2
2009/0148318 A1 6/2009 Kamitani et al.
2010/0196177 A1 8/2010 Hirata et al.
2011/0070109 A1 * 3/2011 Kanai et al. ..... 417/410.2
2011/0070110 A1 3/2011 Hirata

FOREIGN PATENT DOCUMENTS

DE 10 2009 013 913 A1 9/2010
JP 2008-180161 A1 8/2008
WO 2008/069264 A1 6/2008

(Continued)

OTHER PUBLICATIONS

Hirata et al., "Fluid Control Device," U.S. Appl. No. 13/603,689, filed Sep. 5, 2012.

(Continued)

*Primary Examiner* — Charles Freay
(74) *Attorney, Agent, or Firm* — Keating & Bennett, LLP

(57) ABSTRACT

A fluid control device includes a vibrating plate unit, a driver, a flexible plate, and a base plate. The vibrating plate unit includes a vibrating plate including first and second main surfaces, and a frame plate surrounding the surrounding of the vibrating plate. The driver is bonded to the first or the second main surface of the vibrating plate and vibrates the vibrating plate. The flexible plate includes a hole provided therein, and is bonded to the frame plate so as to face the vibrating plate. The base plate is bonded to the main surface of the flexible plate on a side opposite to the vibrating plate. A size relationship between the coefficients of linear expansion of the material of the base plate and the frame plate is equal to a size relationship between the coefficients of linear expansion of the material of the vibrating plate and the driver.

20 Claims, 10 Drawing Sheets

(56) References Cited

FOREIGN PATENT DOCUMENTS

| | | | |
|---|---|---|---|
| WO | 2008/090738 | A1 | 7/2008 |
| WO | 2009/145064 | A1 | 12/2009 |

OTHER PUBLICATIONS

Hirata et al., "Fluid Control Device," U.S. Appl. No. 13/603,701, filed Sep. 5, 2012.

Kodama et al., "Fluid Control Device," U.S. Appl. No. 13/603,724, filed Sep. 5, 2012.

Official Communication issued in corresponding European Patent Application No. 12183355.2, mailed on Dec. 17, 2012.

Official Communication issued in corresponding Japanese Patent Application No. 2011-194429, mailed on Aug. 6, 2013.

* cited by examiner

FLUID CONTROL DEVICE

CROSS REFERENCE

This non-provisional application claims priority under 35 U.S.C. §119(a) to Patent Application No. 2011-194429 filed in Japan on Sep. 6, 2011, the entire contents of which are hereby incorporated by reference.

BACKGROUND OF THE INVENTION

1. Field of the Invention

The present invention relates to a fluid control device which performs fluid control.

2. Description of the Related Art

International Publication No. 2008/069264 discloses a conventional fluid pump (see FIGS. 1A to 1E). FIG. 1A to FIG. 1E show operations of the conventional fluid pump in a tertiary mode. The fluid pump, as shown in FIG. 1A, includes a pump body 10; a vibrating plate 20 in which the outer peripheral portion thereof is attached to the pump body 10; a piezoelectric element 23 attached to the central portion of the vibrating plate 20; a first opening 11 formed on a portion of the pump body 10 that faces the approximately central portion of the vibrating plate 20; and a second opening 12 formed on either one of a region intermediate between the central portion and the outer peripheral portion of the vibrating plate 20 or a portion of the pump body 10 that faces the intermediate region.

The vibrating plate 20 is made of metal. The piezoelectric element 23 has a size so as to cover the first opening 11 and a size so as not to reach the second opening 12.

In the above mentioned fluid pump, by applying voltage having a predetermined frequency to the piezoelectric element 23, a portion of the vibrating plate 20 that faces the first opening 11 and a portion of the vibrating plate 20 that faces the second opening 12 are bent and deformed in opposite directions, as shown in FIG. 1A to FIG. 1E. This causes the fluid pump to draw fluid from one of the first opening 11 and the second opening 12 and to discharge the fluid from the other opening.

The above mentioned fluid pump, as is shown in FIG. 1A with a conventional structure, has a simple structure, and thus the thickness of the fluid pump can be made thinner. Such a fluid pump is used, for example, as an air transport pump of a fuel cell system.

At the same time, electronic equipment and apparatuses into which the fluid pump is incorporated have tended to be miniaturized. Therefore, it is necessary to further miniaturize the fluid pump without reducing the pump performance (the discharge flow rate and the discharge pressure) of the fluid pump.

However, the performance of the fluid pump decreases as the fluid pump becomes smaller. Therefore, there are limitations to miniaturizing the fluid pump having the conventional structure while maintaining the pump performance.

Accordingly, the inventors of the present invention have devised a fluid pump having a structure shown in FIG. 2.

FIG. 2 is a sectional view showing a configuration of a main portion of the fluid pump 901. The fluid pump 901 is provided with a base plate 39, a flexible plate 35, a spacer 37, a vibrating plate 31, and a piezoelectric element 32. The fluid pump 901 is provided with a structure in which the components are layered in that order.

In the fluid pump 901, the piezoelectric element 32 and the vibrating plate 31 bonded to the piezoelectric element 32 constitute an actuator 30. A ventilation hole 35A is formed in the center of the flexible plate 35. The end of the vibrating plate 31 is fixed to the end of the flexible plate 35 by means of an adhesive via the spacer 37. This means that the vibrating plate 31 is supported at a location spaced away from the flexible plate 35 by the thickness of the spacer 37.

The base plate 39 is bonded to the flexible plate 35. A cylindrical opening 40 is formed in the center of the base plate 39. A portion of the flexible plate 35 is exposed to the side of the base plate 39 through the opening 40 of the base plate 39. The circular exposed portion of the flexible plate 35 can vibrate at a frequency that is substantially the same as a frequency of the actuator 30 through the pressure fluctuation of fluid accompanied by the vibration of the actuator 30. In other words, through the configuration of the flexible plate 35 and the base plate 39, the portion of the flexible plate 35 that faces the opening 40 serves as a movable portion 41 that is capable of bending and vibrating. Furthermore, a portion on the outside of the movable portion 41 of the flexible plate 35 serves as a fixing portion 42 fixed to the base plate 39.

In the above structure, when driving voltage is applied to the piezoelectric element 32, the vibrating plate 31 bends and vibrates as a result of the expansion and contraction of the piezoelectric element 32. Furthermore, the movable portion 41 of the flexible plate 35 vibrates with vibration of the vibrating plate 31. This causes the fluid pump 901 to suction or discharge air through the ventilation hole 35A. Consequently, since the movable portion 41 vibrates with the vibration of the actuator 30, the amplitude of vibration of the fluid pump 901 is effectively increased. This allows the fluid pump 901 to produce a high discharge pressure and a large discharge flow rate despite the small size and low profile design thereof.

However, the fluid pump 901 is provided with a structure in which the components are layered. Each of the components is fixed by means of the adhesive agent. For this reason, as the temperature of the fluid pump 901 increased due to heat generation at a time of driving the fluid pump 901 or increases in an environmental temperature, each of the components bends according to differences in each of coefficients of linear expansion. As a result, a distance between the vibrating plate 31 and the flexible plate 35 varies. Here, the distance between the vibrating plate 31 and the flexible plate 35 is an important factor which affects the pressure-flow rate characteristics of the fluid pump 901.

Therefore, a problem exists with the fluid pump 901 in which the pressure-flow rate characteristics of the fluid pump 901 will vary depending on changes in temperature. In other words, the temperature characteristics of the fluid pump 901 are poor.

SUMMARY OF THE INVENTION

Preferred embodiments of the present invention provide a fluid control device that significantly reduces and prevents variations in pressure-flow rate characteristics caused by changes in temperature.

A fluid control device according to a preferred embodiment of the present invention includes a vibrating plate unit, a driver, a flexible plate, and a base plate. The vibrating plate unit includes a vibrating plate including a first main surface and a second main surface, and a frame plate surrounding the surrounding of the vibrating plate. The driver is bonded to either one of the first main surface or the second main surface of the vibrating plate and vibrates the vibrating plate. The flexible plate includes a hole provided on the flexible plate, and is bonded to the frame plate to face the vibrating plate. The base plate is bonded to the main surface of the flexible plate on the side opposite to the vibrating plate. A size relationship between the coefficient of linear expansion of the material of the base plate and the coefficient of linear expansion of the material of the frame plate is equal to a size relationship between the coefficient of linear expansion of the material of either the vibrating plate or the driver, whichever is closer to the flexible plate, and the coefficient of linear expansion of the material of either the vibrating plate or the driver, whichever is farther from the flexible plate.

This configuration includes a first configuration and a second configuration in which the vibrating plate unit, the driver, the flexible plate, and the base plate all bend in different directions.

In the first configuration, either the vibrating plate or the driver, whichever is closer to the flexible plate, is made of a material having a coefficient of linear expansion that is larger than the coefficient of linear expansion of either the vibrating plate or the driver, whichever is farther from the flexible plate. Then, the base plate is made of a material having a coefficient of linear expansion that is larger than the coefficient of linear expansion of the frame plate.

On the other hand, in the second configuration, either the vibrating plate or the driver, whichever is closer to the flexible plate, is made of a material having a coefficient of linear expansion that is smaller than the coefficient of linear expansion of either the vibrating plate or the driver, whichever is farther from the flexible plate. Then, the base plate is made of a material having a coefficient of linear expansion that is smaller than the coefficient of linear expansion of the frame plate.

With this configuration, the vibrating plate unit, the driver, the flexible plate, and the base plate are bonded to each other at a temperature higher than a normal temperature.

For this reason, in the first configuration, after the bonding at the normal temperature, the vibrating plate bends and forms a convex curve on the first main surface on the side opposite to the base plate due to the difference in the coefficients of linear expansion of the vibrating plate unit and the driver while the flexible plate bends and forms a convex curve on the main surface on the side provided with the driver (that is, the side opposite to the base plate) due to the difference in the coefficients of linear expansion of the vibrating plate unit and the base plate. On the other hand, in the second configuration, after the bonding at the normal temperature, the vibrating plate bends and forms a convex curve on the second main surface on the side of the base plate due to the difference in the coefficients of linear expansion of the vibrating plate unit and the driver, and the flexible plate bends and forms a convex curve on the main surface on the side of the base plate due to the difference in the coefficients of linear expansion of the vibrating plate unit and the base plate.

Therefore, with this configuration, in a case where the difference between the coefficient of linear expansion of the vibrating plate unit and the coefficient of linear expansion of the driver is nearly the same as the difference in the coefficients of linear expansion of the vibrating plate unit and the base plate, as the temperature of the fluid control device changes due to heat generated during the drive or due to changes in environmental temperature, both the bending of the vibrating plate as well as the flexible plate reduces by approximately the same amount.

Thus, with this configuration, as each material is selected for use in the vibrating plate unit, the driver, the flexible plate, and the base plate, even if the vibrating plate unit, the driver, the flexible plate, and the base plate deform, due to differences in coefficients of linear expansion when changes in temperature occur, the distance between the vibrating plate and the flexible plate will always remain approximately constant.

Consequently, the fluid control device can significantly reduce and prevent variations in the pressure-flow rate characteristics by changes in temperature.

Preferably, the driver is bonded to the first main surface of the vibrating plate on the side opposite to the base plate, and the flexible plate is bonded to the frame plate so as to face the second main surface of the vibrating plate on the side of the base plate, and the vibrating plate unit is made of a material having a coefficient of linear expansion that is larger than the coefficient of linear expansion of the driver, and the base plate is made of a material having a coefficient of linear expansion that is larger than the coefficient of linear expansion of the vibrating plate unit.

This configuration is included in the above described first configuration. With this configuration, after the bonding, at the normal temperature, the vibrating plate bends and forms a convex curve on the first main surface of the vibrating plate on the side of the driver due to the difference in the coefficients of linear expansion of the vibrating plate unit and the driver, and the flexible plate bends and forms a convex curve on the main surface on the side of the driver due to the difference in the coefficients of linear expansion of the vibrating plate unit and the base plate.

Preferably, the driver is bonded to the second main surface of the vibrating plate on the side of the base plate, and the flexible plate is bonded to the frame plate so as to face the second main surface of the vibrating plate on the side of the base plate, and the driver is made of a material having a coefficient of linear expansion that is larger than the coefficient of linear expansion of the vibrating plate unit, and the base plate is made of a material having a coefficient of linear expansion that is larger than the coefficient of linear expansion of the vibrating plate unit.

This configuration is included in the above described first configuration. With the configuration, after the bonding at the normal temperature, the vibrating plate bends and forms a convex curve on the first main surface opposite to the driver due to the difference between the coefficient of linear expansion of the vibrating plate unit and the coefficient of linear expansion of the driver, and the flexible plate bends and forms a convex curve on the main surface on the side of the driver due to the difference between the coefficient of linear expansion of the vibrating plate unit and the coefficient of linear expansion of the base plate.

Preferably, the vibrating plate unit may further include a link portion which links the vibrating plate and the frame plate, and elastically supports the vibrating plate against the frame plate.

With this configuration, the vibrating plate is flexibly and elastically supported against the frame plate by the link portion. For this reason, the bending vibration of the vibrating plate generated by expansion and contraction of the piezoelectric element cannot be blocked at all. Therefore, in the fluid control device, there will be a reduction in the loss caused by the bending vibration of the vibrating plate.

In addition, the flexible plate is preferably made of a material having a coefficient of linear expansion that is larger than the vibrating plate unit.

Also with this configuration, at the normal temperature, the flexible plate bends and forms a convex curve on the side of the driver due to the differences in the coefficients of linear expansion of the vibrating plate unit, the flexible plate, and the base plate. Additionally, both the bending of the vibrating plate and the flexible plate are reduced as the temperature of the fluid control device increases due to heat generation at the time of driving the fluid control device or by changes of environmental temperature.

Preferably, the vibrating plate forms a convex curve on the side opposite to the base plate, and is elastically supported by the link portion against the frame plate, and the flexible plate forms a convex curve on the side of the driver, and is bonded to the base plate.

With this configuration, at the normal temperature, the vibrating plate bends and forms a convex curve on the side of the driver due to the difference in the coefficients of linear expansion of the vibrating plate unit and the driver, and the flexible plate bends and forms a convex curve on the main surface on the side of the driver due to the difference in the coefficients of linear expansion of the vibrating plate unit and the base plate. Thus, both the bending of the vibrating plate and the flexible plate are reduced as the temperature of the fluid control device increases due to heat generation at the time of driving the fluid control device or due to changes in environmental temperature.

Also it is preferable for the vibrating plate and the link portion to be thinner than the thickness of the frame plate, so that surfaces of the vibrating plate and the link portion on the side of the flexible plate separate from the flexible plate.

With this configuration, the surface of the link portion on the side of the flexible plate is spaced away from the flexible plate by a predetermined distance. Therefore, even if the adhesive agent flows into a gap between the link portion and the flexible plate when the frame plate and the flexible plate are fixed preferably by the adhesive agent, the fluid control device can prevent the link portion and the flexible plate from adhering to each other.

Similarly, with this configuration, the surface of the vibrating plate on the side of the flexible plate is spaced away from the flexible plate by a predetermined distance. For this reason, even if an excess amount of the adhesive agent flows into a gap between the vibrating plate and the flexible plate when the frame plate and the flexible plate are fixed preferably by the adhesive agent, the fluid control device can prevent the vibrating plate and the flexible plate from adhering to each other.

Thus, the fluid control device can prevent the vibration of the vibrating plate from being blocked and can prevent the vibrating plate, the link portion, and the flexible plate from adhering to each other.

Moreover, it is preferable for a hole portion to be formed in a region of the flexible plate facing the link portion.

With this configuration, when the frame plate and the flexible plate are fixed preferably by the adhesive agent, an excess amount of the adhesive agent flows into the hole portion. For that reason, the fluid control device can further prevent the vibrating plate and the link portion, and the flexible plate from adhering to one another. In other words, the fluid control device can further prevent the vibration of the vibrating plate from being blocked by the adhesive agent.

In addition, preferably, the vibrating plate and the driver constitute an actuator, and the actuator has a disk shaped configuration.

With this configuration, the actuator vibrates in a rotationally symmetric pattern (a concentric circular pattern). For this reason, an unnecessary gap is not generated between the actuator and the flexible plate. Therefore, the fluid control device enhances operation efficiency as a pump.

Preferably, the flexible plate includes a movable portion that is positioned in the center or near the center of the region of the flexible plate on a side facing the vibrating plate and can bend and vibrate, and a fixing portion that is positioned outside the movable portion in the region and is substantially fixed.

According to this configuration, the movable portion vibrates with vibration of the actuator. For this reason, in the fluid control device, the amplitude of vibration is effectively increased. Thus, the fluid control device can achieve a higher discharge pressure and a larger discharge flow rate despite the small size and low profile design thereof.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a piezoelectric pump 101 will be described according to a first preferred embodiment of the present invention.

Figure 1A:
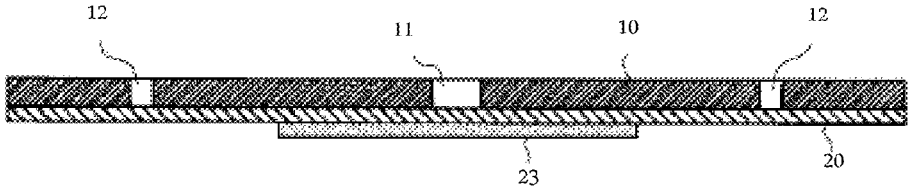
FIG.1A Prior Art
FIG. 1A to FIG. 1E are cross-sectional views of a main part of a conventional fluid pump.
Figure 1B:
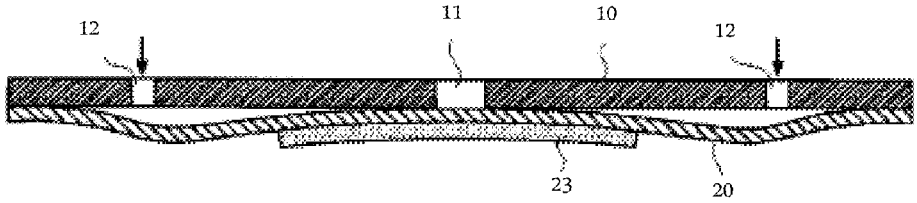
FIG.1B Prior Art
Figure 1C:
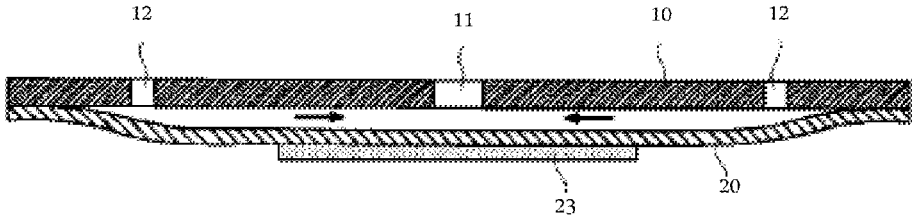
FIG.1C Prior Art
Figure 1D:
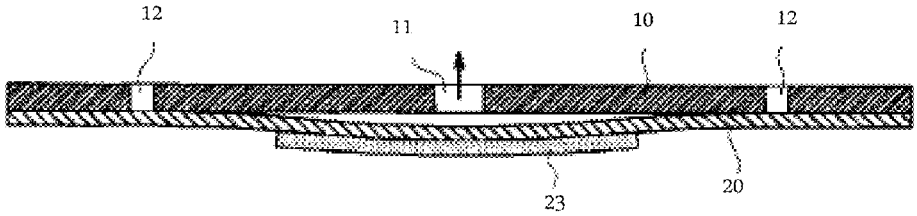
FIG.1D Prior Art
Figure 1E:
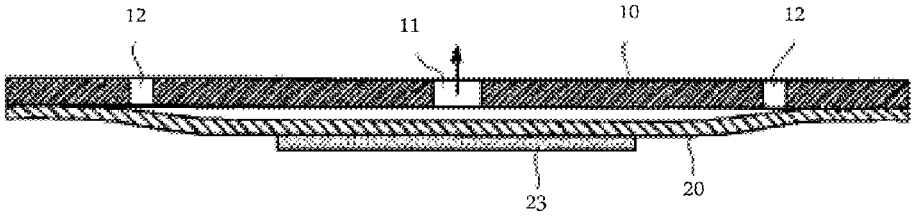
FIG.1E Prior Art
Figure 2:
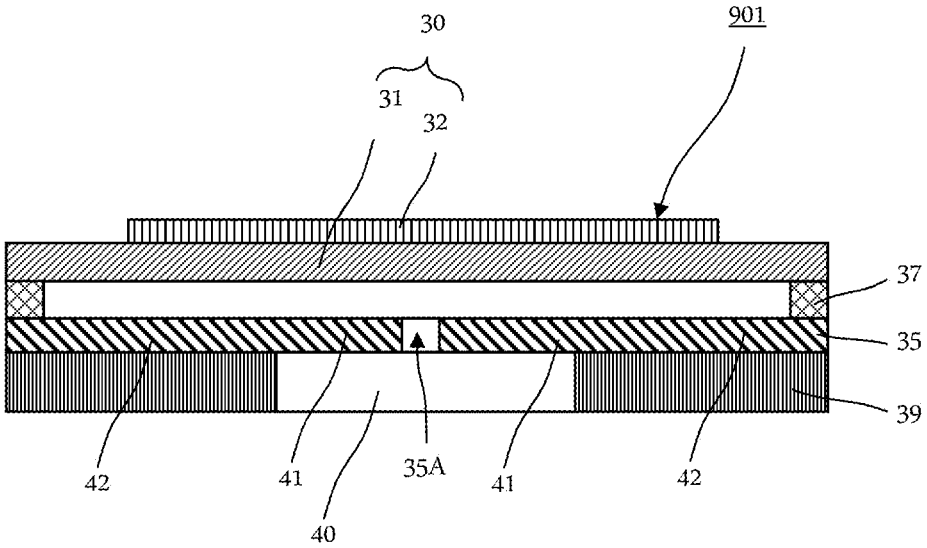
FIG. 2 is a cross-sectional view of a main portion of a fluid pump 901 according to a comparative example of the present invention.
Figure 3:
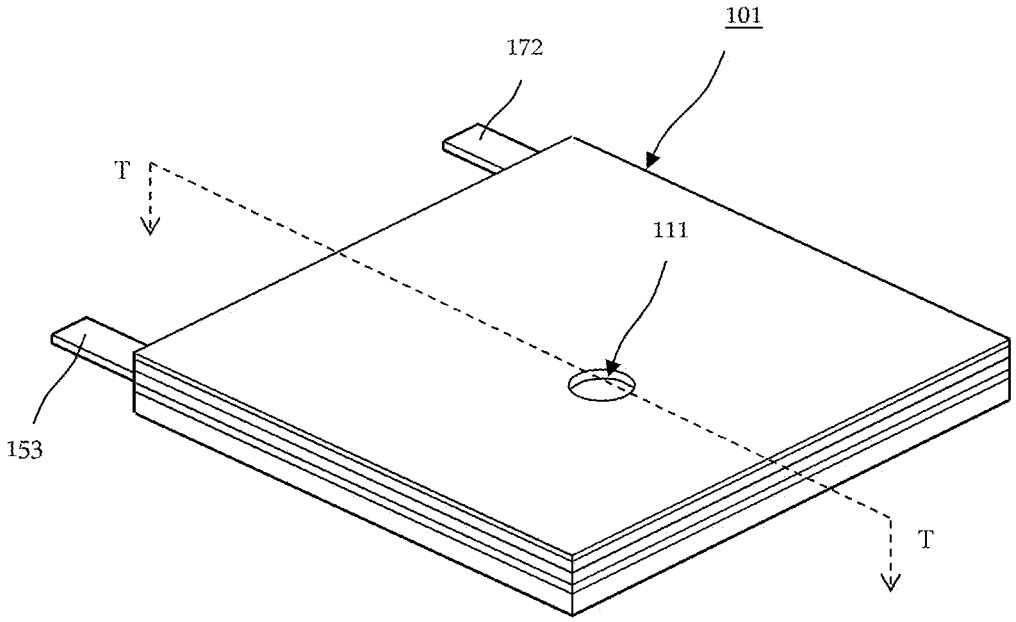
FIG. 3 is an external perspective view of a piezoelectric pump 101 according to a preferred embodiment of the present invention.
Figure 4:
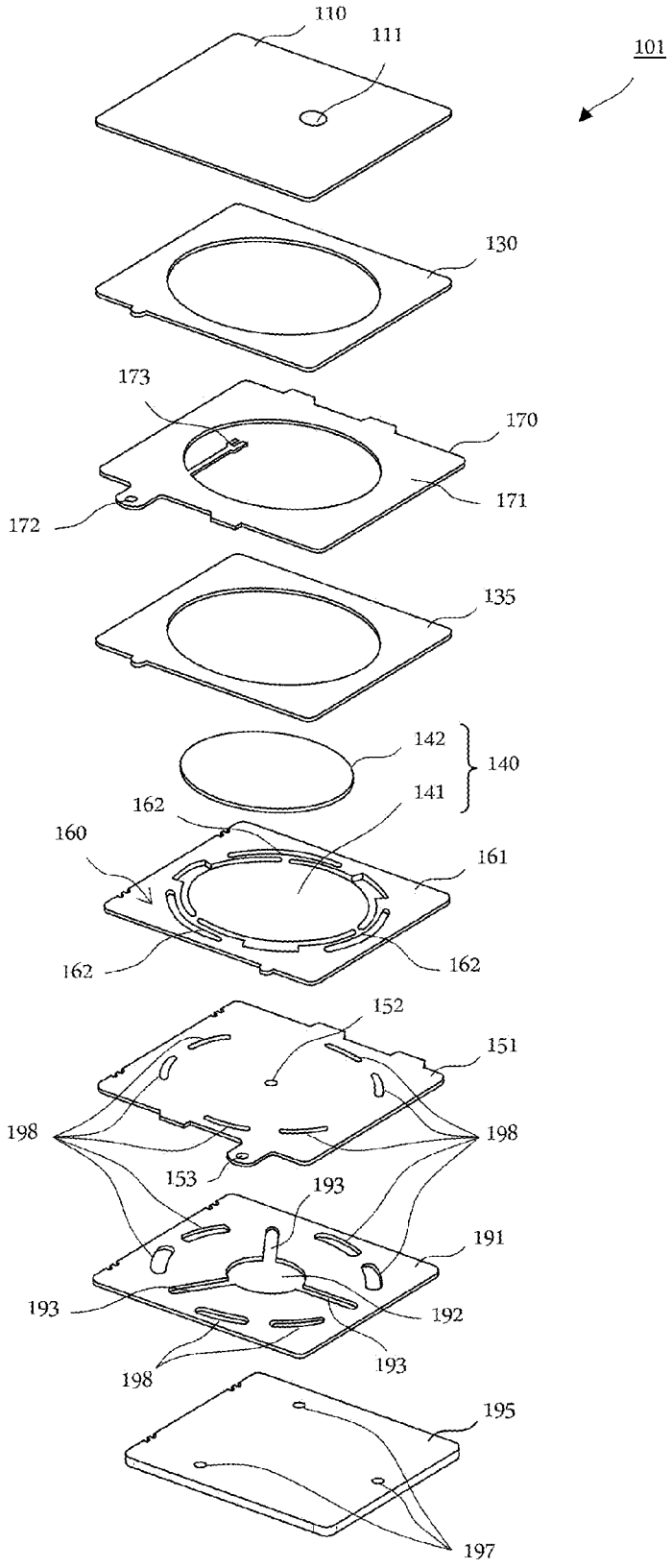
FIG. 4 is an exploded perspective view of the piezoelectric pump 101 as shown in FIG. 3.
Figure 5:
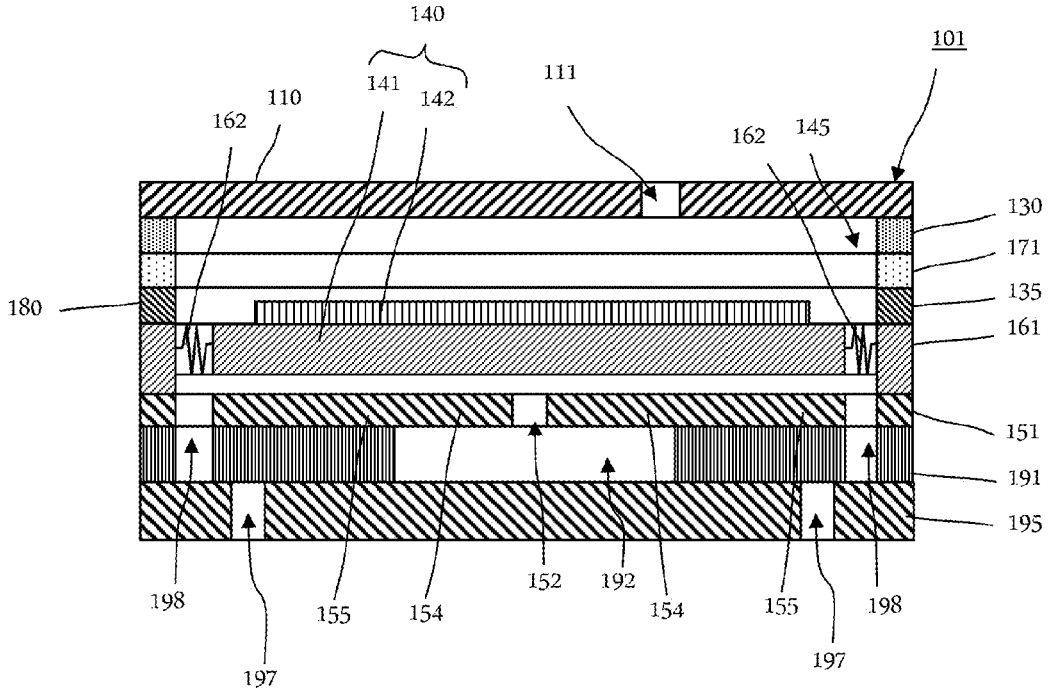
FIG. 5 is a cross-sectional view of the piezoelectric pump 101 as shown in FIG. 3 taken along line T-T.

FIG. 3 is an external perspective view of the piezoelectric pump 101 according to the first preferred embodiment of the present invention. FIG. 4 is an exploded perspective view of the piezoelectric pump 101 as shown in FIG. 3. FIG. 5 is a cross-sectional view of the piezoelectric pump 101 as shown in FIG. 3 taken along line T-T.

As shown in FIG. 3 to FIG. 5, the piezoelectric pump 101 preferably includes a cover plate 195, a base plate 191, a flexible plate 151, a vibrating plate unit 160, a piezoelectric element 142, a spacer 135, an electrode conducting plate 170, a spacer 130, and a lid portion 110. The piezoelectric pump 101 is provided with a structure in which the above components are layered in that order.

A vibrating plate 141 has an upper surface facing the lid portion 110, and a lower surface facing the flexible plate 151.

The piezoelectric element 142 is fixed to the upper surface of the vibrating plate 141 preferably by an adhesive agent. The upper surface of the vibrating plate 141 is equivalent to the "first main surface" according to a preferred embodiment of the present invention. Both the vibrating plate 141 and the piezoelectric element 142 preferably are disc shaped. In addition, the vibrating plate 141 and the piezoelectric element 142 define a disc shaped actuator 140. The vibrating plate unit 160 that includes the vibrating plate 141 is formed of a metal material which has a coefficient of linear expansion greater than the coefficient of linear expansion of the piezoelectric element 142. By applying heat to cure the vibrating plate 141 and the piezoelectric element 142 at time of adhesion, an appropriate compressive stress can be left on the piezoelectric element 142 which allows the vibrating plate 141 to bend and form a convex curve on the side of the piezoelectric element 142. This compressive stress can prevent the piezoelectric element 142 from cracking. For example, it is preferred for the vibrating plate unit 160 to be formed of SUS430. For example, the piezoelectric element 142 may be made of lead titanate zirconate-based ceramics. The coefficient of linear expansion for the piezoelectric element 142 is nearly zero, and the coefficient of linear expansion for SUS430 is about $10.4\times10^{-6}\,K^{-1}$.

It should be noted that the piezoelectric element 142 is equivalent to the "driver" according to a preferred embodiment of the present invention.

The thickness of the spacer 135 may preferably be the same as, or slightly thicker than, the thickness of the piezoelectric element 142.

The vibrating plate unit 160 preferably includes the vibrating plate 141, the frame plate 161, and a link portion 162. The vibrating plate unit 160 is preferably integrally formed by etching a metal plate, for example. The vibrating plate 141 has the frame plate 161 provided therearound. The vibrating plate 141 is linked to the frame plate 161 by the link portion 162. Additionally, the frame plate 161 is fixed to the flexible plate 151 preferably by the adhesive agent.

The vibrating plate 141 and the link portion 162 are preferably thinner than the thickness of the frame plate 161 so that the surfaces of the vibrating plate 141 and the link portion 162 on the side of the flexible plate 151 may separate from the flexible plate 151. The vibrating plate 141 and the link portion 162 are preferably made thinner than the thickness of the frame plate 161 by half etching the surfaces of the vibrating plate 141 and the link portion 162 on the side of the flexible plate 151. Accordingly, a distance between the vibrating plate 141 and the link portion 162, and the flexible plate 151 is accurately determined to a predetermined size (15 μm, for example) by the depth of the half etching. The link portion 162 has an elastic structure having the elasticity of a small spring constant.

Therefore, the vibrating plate 141 is flexibly and elastically supported preferably at three points against the frame plate 161 by three link portions 162, for example. For this reason, the bending vibration of the vibrating plate 141 cannot be blocked at all. In other words, the piezoelectric pump 101 has a structure in which the peripheral portion of the actuator 140 (as well as the central portion) is not substantially fixed.

It is to be noted that the flexible plate 151, an adhesive agent layer 120, the frame plate 161, the spacer 135, the electrode conducting plate 170, the spacer 130, and the lid portion 110 constitute a pump housing 180. Additionally, the interior space of the pump housing 180 is equivalent to a pump chamber 145.

The spacer 135 is adhesively fixed to an upper surface of the frame plate 161. The spacer 135 preferably is made of resin. The thickness of the spacer 135 is the same as or slightly thicker than the thickness of the piezoelectric element 142. Additionally, the spacer 135 constitutes a portion of the pump housing 180. Moreover, the spacer 135 electrically insulates the electrode conducting plate 170, described below, with the vibrating plate unit 160.

The electrode conducting plate 170 is adhesively fixed to an upper surface of the spacer 135. The electrode conducting plate 170 is preferably made of metal. The electrode conducting plate 170 includes a frame portion 171 which is a nearly circular opening, an inner terminal 173 which projects into the opening, and an external terminal 172 which projects to the outside.

The leading edge of the inner terminal 173 is soldered to the surface of the piezoelectric element 142. The vibration of the inner terminal 173 can be significantly reduced and prevented by setting a soldering position to a position equivalent to a node of the bending vibration of the actuator 140.

The spacer 130 is adhesively fixed to an upper surface of the electrode conducting plate 170. The spacer 130 is preferably made of resin. The spacer 130 is a spacer that prevents the soldered portion of the inner terminal 173 from contacting the lid portion 110 when the actuator 140 vibrates. The spacer also prevents the surface of the piezoelectric element 142 from coming too close to the lid portion 110, thus preventing the amplitude of vibration from reducing due to air resistance. For this reason, the thickness of the spacer 130 may be equivalent to the thickness of the piezoelectric element 142.

The lid portion 110 with a discharge hole 111 formed thereon is bonded to an upper surface of the spacer 130. The lid portion 110 covers the upper portion of the actuator 140. Therefore, air sucked through a ventilation hole 152, to be described below, of the flexible plate 151 is discharged from the discharge hole 111.

Here, the discharge hole 111 is a discharge hole which releases positive pressure in the pump housing 180 which includes the lid portion 110. Therefore, the discharge hole 111 need not necessarily be provided in the center of lid portion 110.

An external terminal 153 is arranged on the flexible plate 151 to connect electrically. In addition, a ventilation hole 152 is formed in the center of the flexible plate 151.

On a lower surface of the flexible plate 151, the base plate 191 is attached preferably by the adhesive agent. A cylindrical opening 192 is formed in the center of the base plate 191. A portion of the flexible plate 151 is exposed to the base plate 191 at the opening 192 of the base plate 191. The circularly exposed portion of the flexible plate 151 can vibrate at a frequency substantially the same as a frequency of the actuator 140 through the fluctuation of air pressure accompanying the vibration of the actuator 140. In other words, with the configuration of the flexible plate 151 and the base plate 191, a portion of the flexible plate 151 facing the opening 192 serves as the circular movable portion 154 capable of bending and vibrating. The movable portion 154 corresponds to a portion in the center or near the center of the region facing the actuator 140 of the flexible plate 151. Furthermore, a portion positioned outside the movable portion 154 of the flexible plate 151 serves as the fixing portion 155 that is fixed to the base plate 191. The characteristic frequency of the movable portion 154 is designed to be the same as or slightly lower than the driving frequency of the actuator 140.

Accordingly, in response to the vibration of the actuator 140, the movable portion 154 of the flexible plate 151 also vibrates with large amplitude, centering on the ventilation hole 152. If the vibration phase of the flexible plate 151 is a vibration phase delayed (for example, 90 degrees delayed) from the vibration of the actuator 140, the thickness variation of a gap between the flexible plate 151 and the actuator 140 increases substantially. Through this, the piezoelectric pump 101 can improve pump performance (the discharge pressure and the discharge flow rate).

The cover plate 195 is bonded to a lower surface of the base plate 191. Three suction holes 197 are provided in the cover plate 195. The suction holes 197 communicate with the opening 192 through a passage 193 formed in the base plate 191.

The flexible plate 151, the base plate 191, and the cover plate 195 are preferably made of a material having a coefficient of linear expansion that is greater than a coefficient of linear expansion of the vibrating plate unit 160. In addition, the flexible plate 151, the base plate 191, and the cover plate 195 are preferably made of a material having approximately the same coefficient of linear expansion. For example, it is preferable to have the flexible plate 151 that is made of substances such as beryllium copper. It is preferable to have the base plate 191 that is made of substances such as phosphor bronze. It is preferable to have the cover plate 195 that is made of substances such as copper. These coefficients of linear expansion are approximately $17\times10^{-6}$ $K^{-1}$. Moreover, it is preferable to have the vibrating plate unit 160 that is made of SUS430. The coefficient of linear expansion of SUS430 is about $10.4\times10^{-6}$ $K^{-1}$.

In this case, due to the differences in the coefficients of linear expansion of the flexible plate 151, the base plate 191, and the cover plate 195 in relation to the frame plate 161, by applying heat to cure the flexible plate 151 at a time of adhesion, a tension which makes the flexible plate 151 bend and form a convex curve on the side of the piezoelectric element 142, is applied to the flexible plate 151. Thus, a tension which makes the movable portion capable of bending and vibrating is adjusted on the movable portion 154. Furthermore, the vibration of the movable portion 154 is not blocked due to any slack on the movable portion 154. It is to be understood that since the beryllium copper which constitutes the flexible plate 151 is a spring material, even if the circular movable portion 154 vibrates with large amplitude, there will be no permanent set in fatigue or similar symptoms. In other words, beryllium copper has excellent durability.

In the above structure, when a driving voltage is applied to the external terminals 153, 172, the actuator 140 of the piezoelectric pump 101 concentrically bends and vibrates. Furthermore, in the piezoelectric pump 101, the movable portion 154 of the flexible plate 151 vibrates from the vibration of the vibrating plate 141. Thus, the piezoelectric pump 101 sucks air from the suction hole 197 to the pump chamber 145 through the ventilation hole 152. Then, the piezoelectric pump 101 discharges the air in the pump chamber 145 from the discharge hole 111. In this state of the piezoelectric pump 101, the peripheral portion of the vibrating plate 141 is not substantially fixed. For that reason, the piezoelectric pump 101 achieves significantly lower loss caused by the vibration of the vibrating plate 141, while being small and low profile, and can obtain a high discharge pressure and a large discharge flow rate.

In addition, in the piezoelectric pump 101, the surface of the link portion 162 on the side of the flexible plate 151 is separated from the flexible plate 151. Therefore, the piezoelectric pump 101 can prevent the link portion 162 and the flexible plate 151 from adhering to each other even if an excess amount of the adhesive agent flows into a gap between the link portion 162 and the flexible plate 151.

Similarly, in the piezoelectric pump 101, the lower surface of the vibrating plate 141 on the side of the flexible plate 151 is separated from flexible plate 151. For that reason, the piezoelectric pump 101 can prevent the vibrating plate 141 and the flexible plate 151 from adhering to each other even if the excess amount of the adhesive agent flows into a gap between the vibrating plate 141 and the flexible plate 151. Here, the lower surface of the vibrating plate 141 is equivalent to the "second main surface" according to a preferred embodiment of the present invention.

Thus, the piezoelectric pump 101 can prevent the vibrating plate 141 and the link portion 162 and the flexible plate 151 from adhering to each other and blocking the vibration of the vibrating plate 141.

Additionally, in the piezoelectric pump 101, a difference between the thickness of the vibrating plate 141 and the thickness of the frame plate 161 is equivalent to a distance between the vibrating plate 141 and the flexible plate 151. In other words, in the piezoelectric pump 101, the distance that affects the pressure-flow rate characteristics is determined by the depth of the half etching to the vibrating plate 141.

It is possible to achieve precise setting of the depth of the half etching. Thus, the piezoelectric pump 101 can prevent the pressure-flow rate characteristics from fluctuating with each piezoelectric pump 101.

Figure 6A:
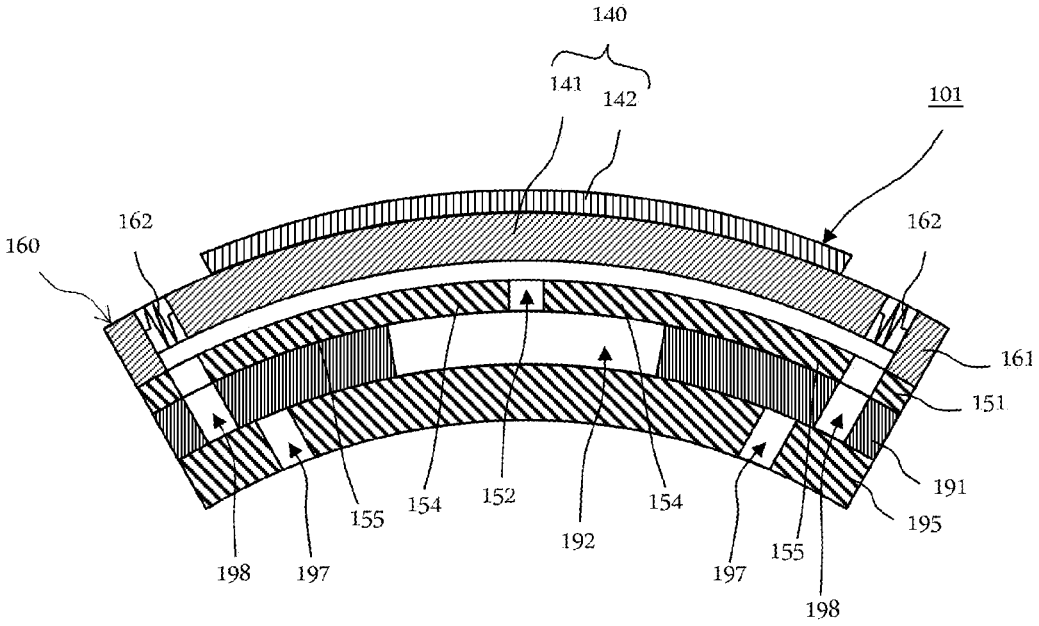
FIG. 6A is a cross-sectional view of a main portion of the piezoelectric pump 101 as shown in FIG. 3 at normal temperature.
Figure 6B:
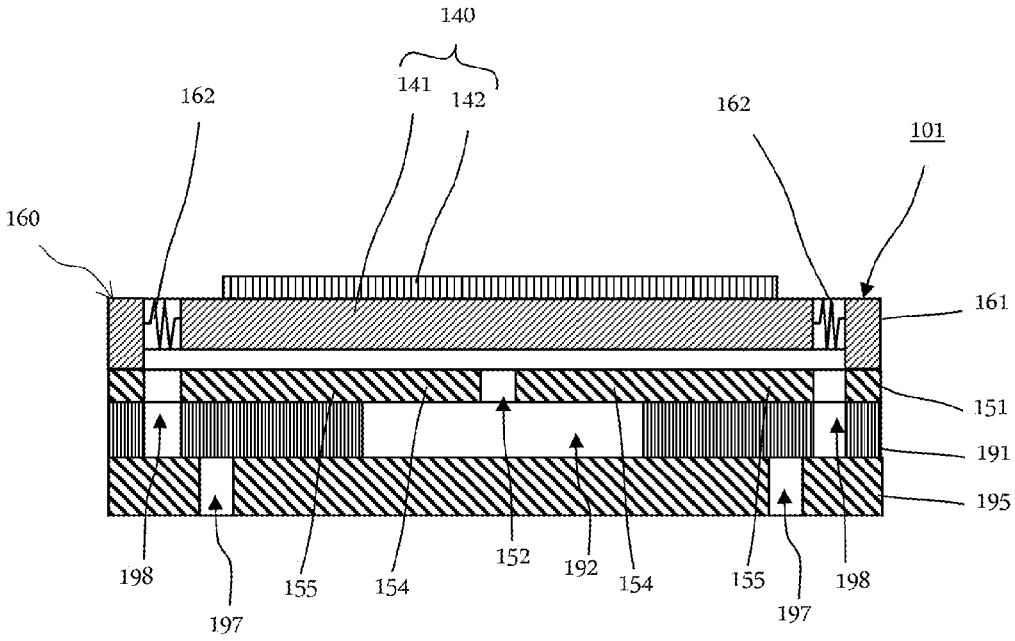
FIG. 6B is a cross-sectional view of the main portion of the piezoelectric pump 101 as shown in FIG. 3 at high temperature.

FIG. 6A is a cross-sectional view of the main portion at normal temperature of the piezoelectric pump 101 as shown in FIG. 3, and FIG. 6B is a cross-sectional view of the main portion at high temperature of the piezoelectric pump 101 as shown in FIG. 3. Here, for illustrative purposes, FIG. 6A highlights the bending of the bonding body of the vibrating plate unit 160, the piezoelectric element 142, the flexible plate 151, the base plate 191, and the cover plate 195 in a scale that is larger than reality. Additionally, in FIGS. 6A and 6B, the lid portion 110, the spacer 130, the electrode conducting plate 170, and the spacer 135 are omitted in the drawing for illustrative purposes.

In the piezoelectric pump 101, the piezoelectric element 142, the vibrating plate unit 160, the flexible plate 151, the base plate 191, and the cover plate 195 are bonded, for example, by an adhesive agent at a temperature (about 120 degrees, for example) higher than a normal temperature (about 20 degrees) (see FIG. 6B). Thus, after the bonding at the normal temperature, the vibrating plate 141 bends and forms a convex curve on the side of the piezoelectric element 142 due to the difference between the coefficient of linear expansion of the vibrating plate unit 160 and the coefficient of linear expansion of the piezoelectric element 142. Furthermore, the flexible plate 151 bends and forms a convex curve on the side of the piezoelectric element 142 due to the difference between the coefficient of linear expansion of the above mentioned vibrating plate unit 160 and the coefficient of linear expansion of the base plate 191 (see FIG. 6A).

At the normal temperature, the vibrating plate 141 and the flexible plate 151 bend and form convex curves on the side of the piezoelectric element 142 by approximately the same amount. Then, both the bending of the vibrating plate 141 and the flexible plate 151 are reduced by approximately the same amount as the temperature of the piezoelectric pump 101 increases due to heat generation at the time of driving the piezoelectric pump 101 or due to changes in environmental temperature.

Therefore, even if the vibrating plate unit 160, the piezoelectric element 142, the flexible plate 151, and the base plate 191 deform by the difference in each of the coefficients of linear expansion due to changes in temperature, the distance between the vibrating plate 141 and the flexible plate 151 is always maintained constant by selecting each material for the vibrating plate unit 160, the piezoelectric element 142, the flexible plate 151, and the base plate 191 as described above.

Consequently, the piezoelectric pump 101 can significantly reduce and prevent a variation in the pressure-flow rate characteristics caused by changes in temperature. That is, the piezoelectric pump 101 can maintain proper pressure-flow rate characteristics of a pump over a wide temperature range.

Figure 7:
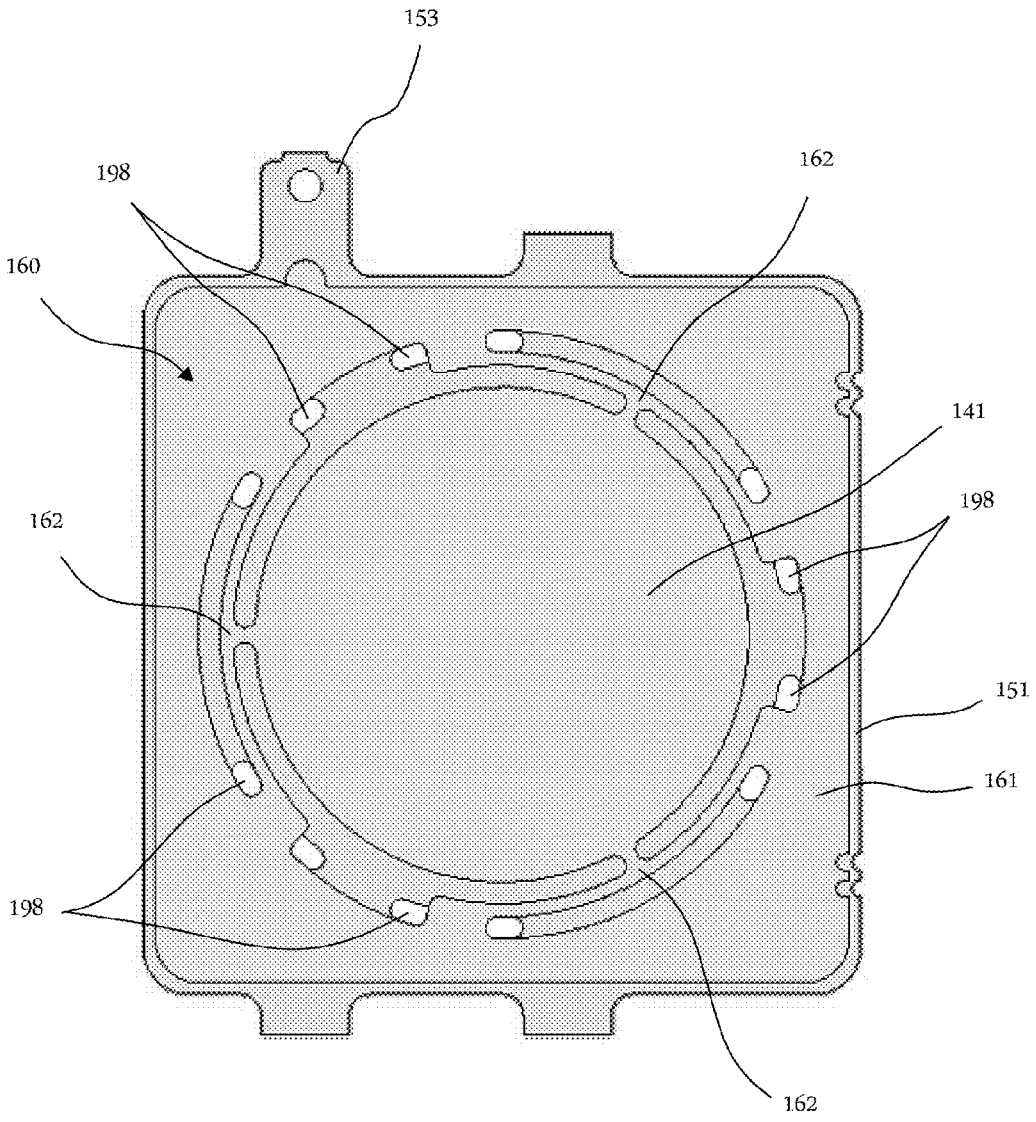
FIG. 7 is a plan view of a bonding body of the vibrating plate unit 160 and the flexible plate 151 as shown in FIG. 4.

FIG. 7 is a plan view of a bonding body of the vibrating plate unit 160 and the flexible plate 151 as shown in FIG. 4.

As shown in FIG. 4 to FIG. 7, it is preferable that a hole portion 198 is provided in the region facing the link portion 162 in the flexible plate 151 and the base plate 191. Thus, when the frame plate 161 and the flexible plate 151 are fixed preferably by the adhesive agent, an excess amount of the adhesive agent flows into the hole portion 198.

Therefore, the piezoelectric pump 101 can further prevent the vibrating plate 141 and the link portion 162 and the flexible plate 151 from adhering to each other. In other words, the piezoelectric pump 101 can further prevent the vibration of the vibrating plate 141 from being blocked.

It is to be noted that in the piezoelectric pump 101, the lid portion 110 may be fixed to the spacer 130 using a silicone adhesive having low elasticity, for example. Alternatively, in place of the lid portion 110 and the spacer 130, a bulb structure defined by a resin molded article, rubber, and other suitable material may be fixed to the electrode conducting plate 170 using the silicone adhesive having low elasticity, for example. With the former configuration, generation of thermal stress between the lid portion 110 and the spacer 130 is suppressed with by the silicone adhesive of low elasticity. Moreover, with the latter configuration, generation of thermal stress between the bulb structure and the electrode conducting plate 170 is suppressed by the silicone adhesive of low elasticity.

As described above, when the generation of thermal stress is significantly reduced and prevented, the deformation of the vibrating plate unit 160 and the base plate 191 due to changes in the temperature of the piezoelectric pump 101 cannot be blocked. In other words, the effects of the lid portion 110 and the bulb structure are eliminated. For that reason, the piezoelectric pump 101 can further reduce and prevent variations in the pressure-flow rate characteristics by changes in temperature.

Other Preferred Embodiments

Figure 8A:
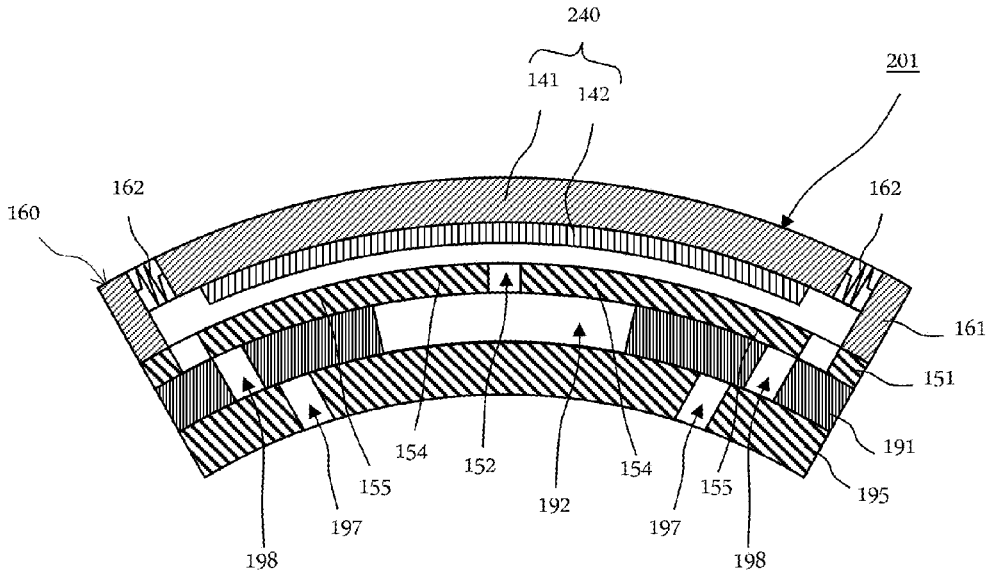
FIG. 8A is a cross-sectional view of a main portion of a piezoelectric pump 201 at normal temperature according to another preferred embodiment of the present invention.
Figure 8B:
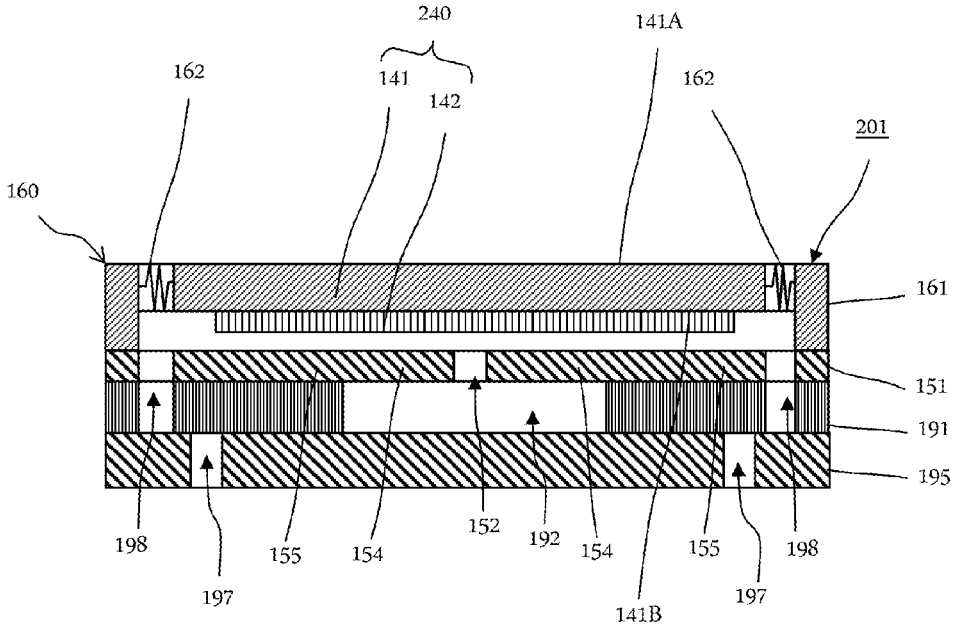
FIG. 8B is a cross-sectional view of the main portion of the piezoelectric pump 201 at high temperature according to another preferred embodiment of the present invention.

In the above described preferred embodiments, as shown in FIG. 6A and FIG. 6B, while the actuator 140 is configured preferably by bonding the piezoelectric element 142 to the upper surface of the vibrating plate 141 on the side opposite to the flexible plate 151, the configuration is not limited thereto. In a piezoelectric pump 201 as shown in FIG. 8A and FIG. 8B, for example, an actuator 240 may be configured by bonding the piezoelectric element 142 to the lower surface of the vibrating plate 141 on the side of the flexible plate 151. However, in the piezoelectric pump 201 as shown in FIG. 8A and FIG. 8B, the piezoelectric element 142 is preferably made of a material having a coefficient of linear expansion that is larger than the coefficient of linear expansion of the vibrating plate unit 160.

While the actuator 140 having a unimorph type structure and undergoing bending vibration was preferably provided in the above mentioned preferred embodiments, the structure is not limited thereto. For example, it is possible to attach a piezoelectric element 142 on both sides of the vibrating plate 141 so as to have a bimorph type structure and undergo bending vibration.

Moreover, in the above described preferred embodiments, while the actuator 140 which undergoes bending vibration by expansion and contraction of the piezoelectric element 142 was preferably provided, the method is not limited thereto. For example, an actuator which electromagnetically undergoes bending vibration may be provided.

In the preferred embodiments, while the piezoelectric element 142 is preferably made of lead titanate zirconate-based ceramics, the material is not limited thereto. For example, an actuator may be made of a piezoelectric material of non-lead based piezoelectric ceramics such as potassium-sodium niobate based or alkali niobate based ceramics.

Figure 9A:
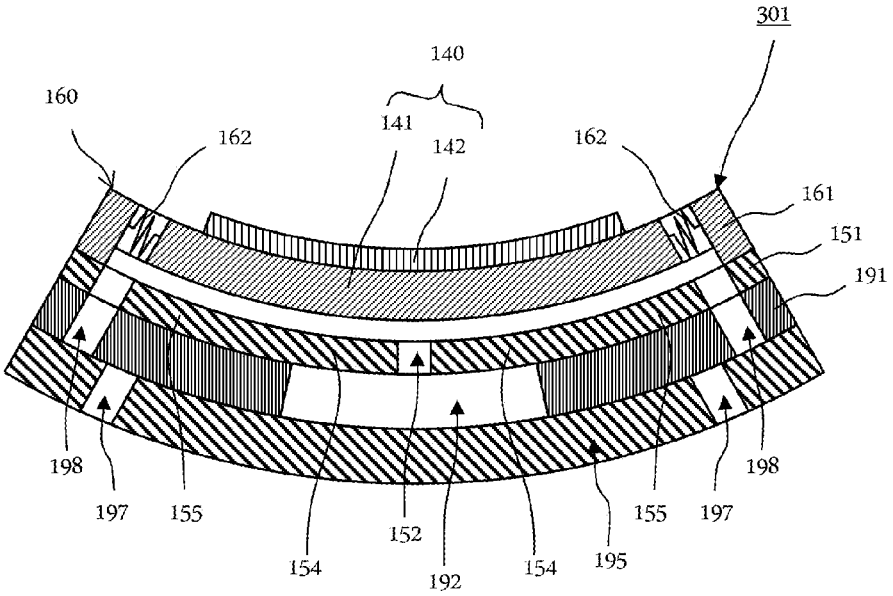
FIG. 9A is a cross-sectional view of a main portion of a piezoelectric pump 301 at normal temperature according to another preferred embodiment of the present invention.

While the above-mentioned preferred embodiment shows an example in FIG. 6A in which the vibrating plate unit 160, the flexible plate 151, and the base plate 191 preferably form convex curves on the side of the piezoelectric element 142 at normal temperature, the structure is not limited thereto. For example, even if the vibrating plate unit 160, the piezoelectric element 142, the flexible plate 151, and the base plate 191 deform due to the difference in each of the coefficients of linear expansion caused by changes in temperature, as long as the distance can always remain constant between the vibrating plate 141 and the flexible plate 151, the configuration such as the piezoelectric pump 301 as shown in FIG. 9A may be used. In other words, as shown in FIG. 9A, at normal temperature, the vibrating plate unit 160, the flexible plate 151, and the base plate 191 may form convex curves on the sides opposite to the piezoelectric element 142. However, in the piezoelectric pump 301 as shown in FIG. 9A and FIG. 9B, the piezoelectric element 142 is preferably made of a material having a coefficient of linear expansion that is larger than the coefficient of linear expansion of the vibrating plate unit 160, and the vibrating plate unit 160 is preferably made of a material having a coefficient of linear expansion that is larger than the coefficient of linear expansion of the base plate 191.

Figure 9B:
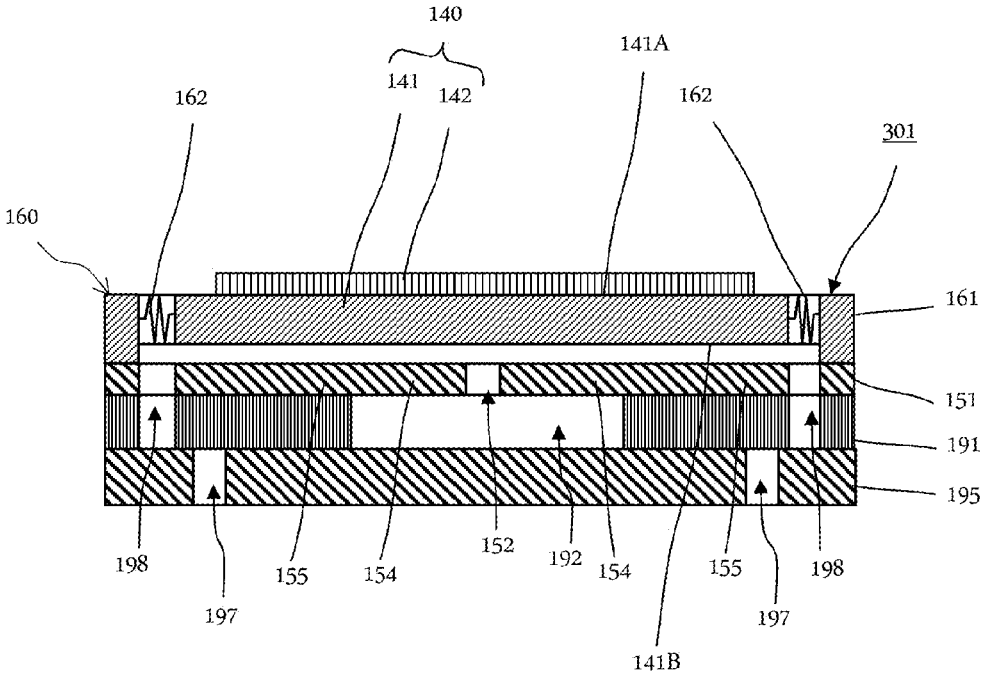
FIG. 9B is a cross-sectional view of the main portion of the piezoelectric pump 301 at high temperature according to another preferred embodiment of the present invention.
Figure 10A:
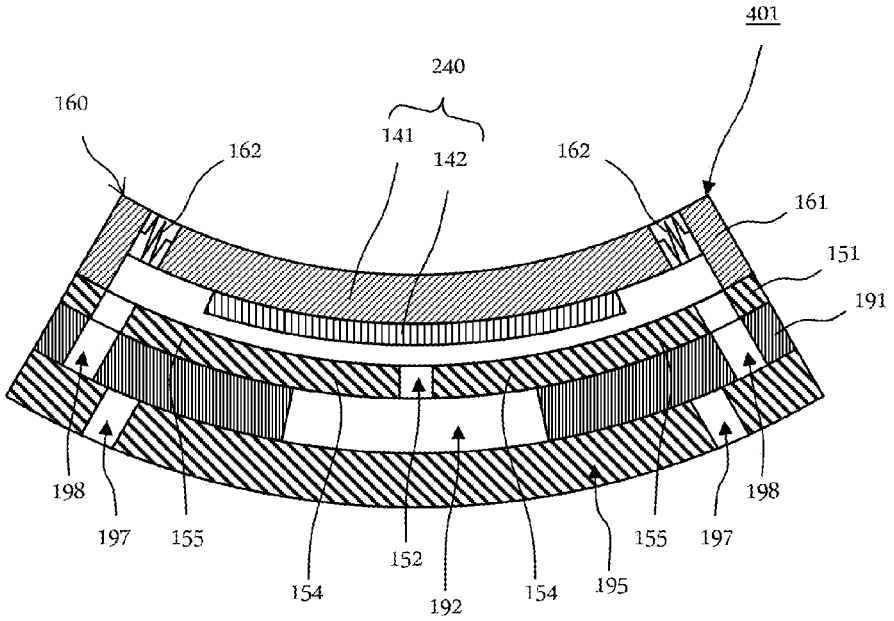
FIG. 10A is a cross-sectional view of a main portion of a piezoelectric pump 401 at normal temperature according to another preferred embodiment of the present invention.
Figure 10B:
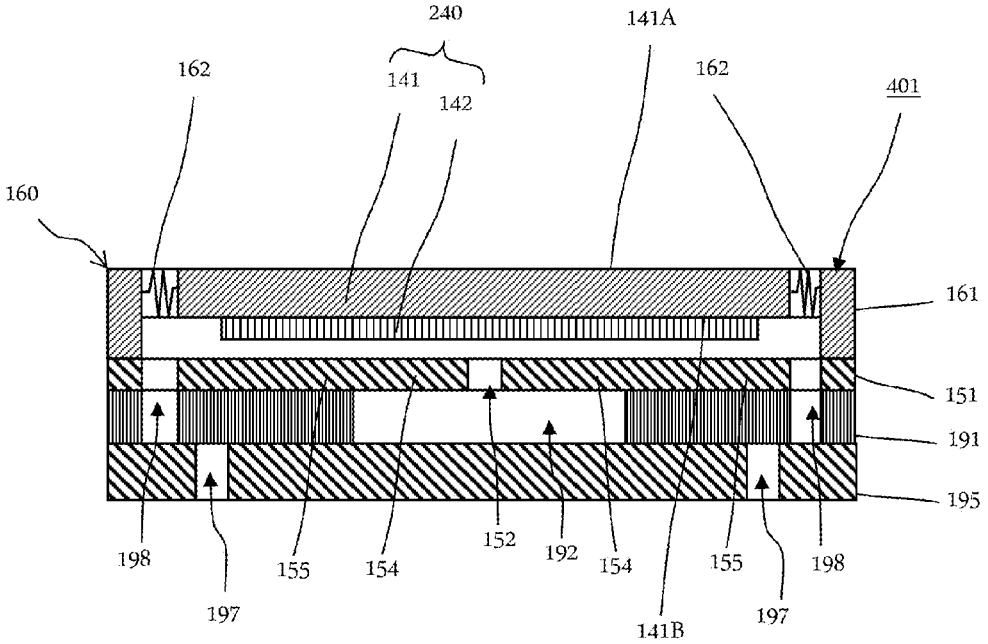
FIG. 10B is a cross-sectional view of the main portion of the piezoelectric pump 401 at high temperature according to another preferred embodiment of the present invention.

In addition, in the piezoelectric pump 301 as shown in FIG. 9A and FIG. 9B, while the actuator 140 is configured preferably by bonding the piezoelectric element 142 to the upper surface of the vibrating plate 141 on the side opposite to the flexible plate 151, the configuration is not limited thereto. In a piezoelectric pump 401 as shown in FIG. 10A and FIG. 10B, for example, the actuator 240 may be configured by bonding the piezoelectric element 142 to the lower surface of the vibrating plate 141 on the side of the flexible plate 151. However, in the piezoelectric pump 401 as shown in FIG. 10A and FIG. 10B, the piezoelectric element 142 is preferably made of a material having a coefficient of linear expansion that is larger than the coefficient of linear expansion of the vibrating plate unit 160.

Additionally, while the above described preferred embodiments showed an example in which the piezoelectric element 142 and the vibrating plate 141 preferably have roughly the same size, there are no limitations to the size. For example, the vibrating plate 141 may be larger than the piezoelectric element 142.

Moreover, although the disc shaped piezoelectric element 142 and the disc shaped vibrating plate 141 were preferably included in the above mentioned preferred embodiments, there are no limitations to the shape. For example, either of the piezoelectric element 142 or the vibrating plate 141 can be a rectangle or a polygon.

In addition, while a thickness of the entire vibrating plate 141 is preferably thinner than the thickness of the frame plate 161, there are no limitations to the thickness. For example, the thickness of at least a portion of the vibrating plate 141 may be preferably thinner than the thickness of the frame plate 161. However, a portion of the vibrating plate 141 is preferred to be an end of the vibrating plate, of the entire vibrating plate 141, nearest to an adhesion portion between the flexible plate 151 and the frame plate 161.

Moreover, in the above described preferred embodiment, while the link portion 162 is preferably provided at three spots, the number of places is not limited thereto. For example, the link portion 162 may be provided at only two spots or the link portion 162 may be provided at four or more spots. Although the link portion 162 does not block vibration of the actuator 140, the link portion 162 does more or less affect the vibration of the actuator 140. Therefore, the actuator 140 can be held naturally by linking (holding) the actuator at three spots, for example, and the position of the actuator 140 is held accurately. The piezoelectric element 142 can also be prevented from cracking.

Furthermore, the actuator 140 may be driven in an audible frequency band in various preferred embodiments of the present invention if it is used in an application in which the generation of audible sounds does not cause problems.

In addition, while the above described preferred embodiments show an example in which one ventilation hole 152 is disposed at the center of a region facing the actuator 140 of the flexible plate 151, there are no limitations to the number of holes. For example, a plurality of holes may be disposed near the center of the region facing the actuator 140.

Further, while the frequency of driving voltage in the above mentioned preferred embodiments is determined so as to make the actuator 140 vibrate in a primary mode, there are no limitations to the mode. For example, the driving voltage frequency may be determined so as to vibrate the actuator 140 in other modes such as a tertiary mode.

In addition, while air is used as fluid in the above mentioned preferred embodiments, the fluid is not limited thereto. For example, any kind of fluid such as liquids, gas-liquid mixture, solid-liquid mixture, and solid-gas mixture can be applied to the above preferred embodiment.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fluid control device comprising:

a vibrating plate unit including:

a vibrating plate including a first main surface and a second main surface, the second main surface being opposed to the first main surface; and a frame plate that surrounds the vibrating plate; and a flexible plate that is provided with a hole on the flexible plate and bonded to the frame plate so as to face the second main surface of the vibrating plate;

a base plate that is bonded to a main surface of the flexible plate on a side opposite to the vibrating plate; and a driver that is bonded to the first main surface of the vibrating plate; wherein the vibrating plate unit is made of a material having a coefficient of linear expansion that is larger than a coefficient of linear expansion of the driver; and the base plate is made of a material having a coefficient of linear expansion that is larger than the coefficient of linear expansion of the vibrating plate unit.

2. The fluid control device according to claim 1, wherein the vibrating plate unit further comprises a link portion that links the vibrating plate and the frame plate, and elastically supports the vibrating plate against the frame plate.

3. The fluid control device according to claim 2, wherein the vibrating plate forms a convex curve on a side opposite to the base plate, and is elastically supported by the link portion against the frame plate, and the flexible plate forms a convex curve on a side of the driver, and is bonded to the base plate.

4. The fluid control device according to claim 2, wherein the vibrating plate and the link portion are thinner than a thickness of the frame plate so that surfaces of the vibrating plate and the link portion on a side of the flexible plate separate from the flexible plate.

5. The fluid control device according to claim 2, wherein the flexible plate comprises a hole portion in a region of the flexible plate that faces the link portion.

6. The fluid control device according to claim 1, wherein the flexible plate is made of a material having a coefficient of linear expansion that is larger than the coefficient of linear expansion of the vibrating plate unit.

7. The fluid control device according to claim 1, wherein the vibrating plate and the driver constitute an actuator and the actuator is disc shaped.

8. The fluid control device according to claim 1, wherein the flexible plate comprising:

a movable portion that is positioned in a center or in an area of the center of a region of the flexible plate on a side that faces the vibrating plate and can bend and vibrate; and a fixing portion that is positioned outside the movable portion in the region and is substantially fixed.

9. A fluid control device comprising:

a vibrating plate unit including:

a vibrating plate including a first main surface and a second main surface, the second main surface being opposed to the first main surface; and a frame plate that surrounds the vibrating plate; and a flexible plate that is provided with a hole on the flexible plate and bonded to the frame plate so as to face the second main surface of the vibrating plate;

a base plate that is bonded to a main surface of the flexible plate on a side opposite to the vibrating plate; and a driver that is bonded to the second main surface of the vibrating plate; wherein:

the driver is made of a material having a coefficient of linear expansion that is larger than a coefficient of linear expansion of the vibrating plate unit; and the base plate is made of a material having the coefficient of linear expansion that is larger than the coefficient of linear expansion of the vibrating plate unit.

10. The fluid control device according to claim 9, wherein the vibrating plate unit further comprises a link portion that links the vibrating plate and the frame plate, and elastically supports the vibrating plate against the frame plate.

11. The fluid control device according to claim 10, wherein the vibrating plate and the link portion are thinner than a thickness of the frame plate so that surfaces of the vibrating plate and the link portion on a side of the flexible plate separate from the flexible plate.

12. The fluid control device according to claim 10, wherein the flexible plate comprises a hole portion in a region of the flexible plate that faces the link portion.

13. A fluid control device comprising:

a vibrating plate unit including:

a vibrating plate including a first main surface and a second main surface, the second main surface being opposed to the first main surface; and a frame plate that surrounds the vibrating plate; and a flexible plate that is provided with a hole on the flexible plate and bonded to the frame plate so as to face the second main surface of the vibrating plate;

a base plate that is bonded to a main surface of the flexible plate on a side opposite to the vibrating plate; and a driver that is bonded to the first main surface of the vibrating plate; wherein the vibrating plate unit is made of a material having a coefficient of linear expansion that is smaller than a coefficient of linear expansion of the driver, the base plate is made of a material having a coefficient of linear expansion that is smaller than the coefficient of linear expansion of the vibrating plate unit.

14. The fluid control device according to claim 13, wherein the vibrating plate unit further comprises a link portion that links the vibrating plate and the frame plate, and elastically supports the vibrating plate against the frame plate.

15. The fluid control device according to claim 14, wherein the vibrating plate and the link portion are thinner than a thickness of the frame plate so that surfaces of the vibrating plate and the link portion on a side of the flexible plate separate from the flexible plate.

16. The fluid control device according to claim 14, wherein the flexible plate comprises a hole portion in a region of the flexible plate that faces the link portion.

17. A fluid control device comprising:

a vibrating plate unit including:

a vibrating plate including a first main surface and a second main surface, the second main surface being opposed to the first main surface; and a frame plate that surrounds the vibrating plate; and a flexible plate that is provided with a hole on the flexible plate and bonded to the frame plate so as to face the second main surface of the vibrating plate;

a base plate that is bonded to a main surface of the flexible plate on a side opposite to the vibrating plate; and a driver that is bonded to the second main surface of the vibrating plate; wherein:

the driver is made of a material having a coefficient of linear expansion that is smaller than a coefficient of linear expansion of the vibrating plate unit; and the base plate is made of a material having the coefficient of linear expansion that is smaller than the coefficient of linear expansion of the vibrating plate unit.

18. The fluid control device according to claim 17, wherein the vibrating plate unit further comprises a link portion that links the vibrating plate and the frame plate, and elastically supports the vibrating plate against the frame plate.

19. The fluid control device according to claim 18, wherein the vibrating plate and the link portion are thinner than a thickness of the frame plate so that surfaces of the vibrating plate and the link portion on a side of the flexible plate separate from the flexible plate.

20. The fluid control device according to claim 18, wherein the flexible plate comprises a hole portion in a region of the flexible plate that faces the link portion.

* * * * *